United States Patent [19]

Jonat

[11] Patent Number: 4,787,100

[45] Date of Patent: Nov. 29, 1988

[54] CHILDREN'S ITEM OF APPAREL WITH FOOTWEAR ACTUATED NOISEMAKER

[76] Inventor: Michael Jonat, 6 Adrienne Pl., White Plains, N.Y. 10605

[21] Appl. No.: 79,529

[22] Filed: Jul. 30, 1987

[51] Int. Cl.[4] ..... A41D 11/00; A43B 3/30

[52] U.S. Cl. ..... 2/80; 2/83; 36/112; 36/139; 446/26

[58] Field of Search ..... 36/139, 112, 1, 9 R, 36/137; 2/80, 83; 446/26, 28

[56] References Cited

U.S. PATENT DOCUMENTS

| | | | |
|---|---|---|---|
| 2,502,393 | 3/1950 | Sladek et al. | 36/1 X |
| 2,725,567 | 12/1955 | Bevier | 2/83 |
| 2,746,054 | 5/1956 | Heilbronner | 2/83 |
| 3,015,170 | 1/1962 | Kramer | 36/9 R |
| 3,221,422 | 12/1965 | Lemeshnik | 36/9 R |
| 3,432,964 | 3/1969 | Visitacion | 446/26 |
| 3,653,074 | 4/1972 | Nobile et al. | 2/80 |
| 3,702,999 | 11/1972 | Gradisar | 36/139 X |
| 3,878,641 | 4/1975 | Noble | 36/139 X |
| 4,253,254 | 3/1981 | Gill | 36/139 |
| 4,350,853 | 9/1982 | Ganyard | 36/137 X |

*Primary Examiner*—James Kee Chi

*Attorney, Agent, or Firm*—Lilling & Greenspan

[57] ABSTRACT

An item of children's apparel includes a foot portion consisting of a sole formed of a number of layers, an intermediate layer of which is provided with a cavity or recess which houses, in the toe portion, a squeaker or other noisemaker which is involuntarily actuated by the child during normal walking when the child applies pressure to the toe portion.

18 Claims, 1 Drawing Sheet

CHILDREN'S ITEM OF APPAREL WITH FOOTWEAR ACTUATED NOISEMAKER

BACKGROUND OF THE INVENTION

1. Field of the Invention

The invention generally relates to items of apparel, and, more specifically, to an item of children's apparel which includes a footwear actuated noisemaker.

2. Description of the Prior Art

Numerous patents have been issued which disclose shoes and the like which incorporate noisemakers of various types. In most instances, the noisemakers are intended for the after market and are adapted to be attached to existing shoes. Exemplary of such devices are those which are described in U.S. Pat. Nos. 1,140,635; 2,454,228; 2,721,420; 2,811,811; 3,340,846 and 4,253,254. In some cases, the noisemakers are incorporated with the shoe when originally manufactured and sold. See, U.S. Pat. Nos. 2,612,135, and 4,043,241, wherein a musical shoe is disclosed in which an electronic circuit is provided inside the shoe.

In U.S. Pat. No. 2,160,756, a children's slipper is disclosed which includes a whistle or sounding device on the front or toe portion of the shoe. However, the sound maker is placed on top of the shoe, above the children's toes, and the whistle, squawker or sounding device is operated only upon the voluntary application of a light pressure to the sound maker or by the intentional wiggling or flexing of the toes by the user of the slipper. Therefore, the slipper described in the aforementioned patent does not produce involuntary sounds during normal walking by the child, but requires an overt action in order to produce the noise.

In U.S. Pat. No. 2,582,699, a child's garment is disclosed which includes a sounding novelty device. Here, again, the sound emitting device is under the control of the child wearing the garment and the desired sounds are only produced when the child voluntarily pulls a cord. Absence such intentional action, no noises are produced.

It is an object of the present invention to provide an item of children's apparel which incorporates a foot portion adapted to involuntarily produce sounds or noises during normal walking by an infant or a child, without the need for special, voluntary actions to produce such sounds or noises. Such an item can be used as a novelty item that is amusing to the infant and to adults, and to assist parents and guardians to quickly locate their children.

In order to achieve the aforementioned object, as well as others which will become apparent hereafter, an item of children's apparel in accordance with the present invention includes a foot portion adapted to receive the foot of a child. Said foot portion includes an upper, and a sole which defines a toe portion formed of a resilient material. Said toe portion has an enclosed cavity. A noisemaker means is provided within said cavity for generating a predetermined noise when pressure is applied thereto when the child involuntarily applies pressure to said toe portion during normal walking to thereby depress said toe portion and compress said cavity and said noisemaker means to generate the desired noise effect.

In accordance with one embodiment of the invention, the item of apparel is a child's sleeping garment having a legged pants portion.

BRIEF DESCRIPTION OF THE DRAWINGS

For a better understanding of the invention, reference may be made to the following description of an exemplary embodiment, taken in conjunction with the figures of the accompanying drawing in which.

DESCRIPTION OF THE PREFERRED EMBODIMENT

Figure 1:
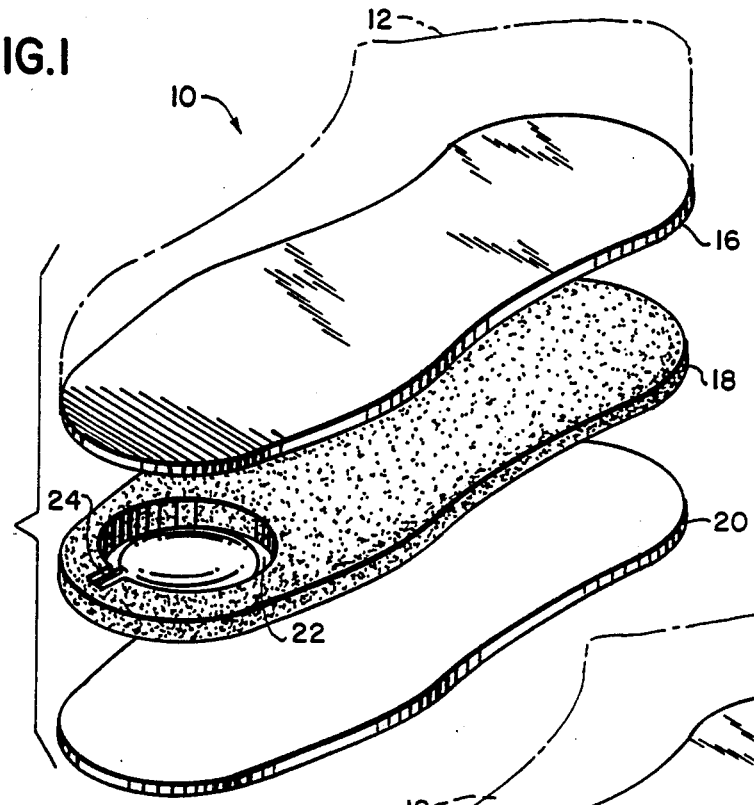
FIG. 1 is an exploded perspective view of an item of children's apparel in accordance with the present invention, showing the different layers of the sole which may be used to achieve the objects of the present invention.

Referring now specifically to the drawings, in which the identical or similar parts are designated by the same reference numerals throughout, and first referring to FIG. 1, an item of children's apparel in accordance with the present invention is generally designated by the reference numeral 10. The garment 10 is shown to comprise, in phantom outline, an upper in which may form part of any children's garment. For example, it is contemplated that the present invention can be used with a child's sleeping garment having a legged pants portion of the type, for example, disclosed in U.S. Pat. No. 2,929,072 or U.S. Pat. No. 3,653,074. The invention can also be used, however, with other children's garments, such as children's slippers.

Figure 2:
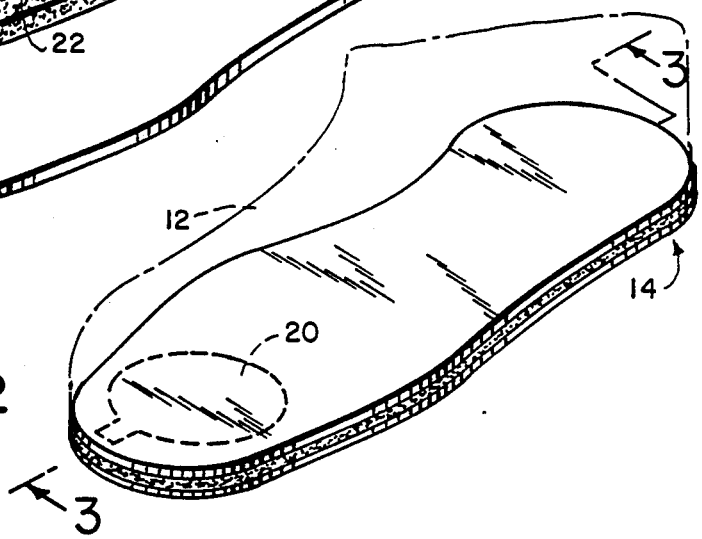
FIG. 2 is a perspective view, partially in phantom outline, showing the assembled sole formed of the component layers shown in FIG. 1.

The upper 12 is attached to a sole generally designated by the reference numeral 14 in FIG. 2 which defines a heel portion **14*a* and a forward toe portion 14*b* formed of a resilient material. In one presently preferred embodiment, the sole 14 includes an upper layer 16, a middle or intermediate layer 18 and a lower layer 20. The three layers, 16, 18 and 20, are attached or laminated to each other in any suitable and conventional way, as is well known to those skilled in the art. As exemplified in FIGS. 1 and 2, the toe portion 14*b* is provided with a cavity 22, which may include an additional elongate recess 24**, for reasons which will become apparent.

A noisemaker 26 (FIG. 3) is disposed within the cavity 22 for generating a predetermined noise when pressure is applied thereto. In accordance with one embodiment, the noisemaker 26 is in the form of a deformable, resilient bulbous portion **26*a* attached to a neck portion 26*b* which includes a reed element or other suitable noise or sound making element of conventional design. The elongate portion 26*b* may, for example, be arranged within the recess 24**.

It should be evident that a child wearing the garment 10 will, during normal walking, involuntarily apply pressure to the toe portion **14*b* to thereby compress the cavity 22 and the noisemaker 26** to generate the desired noise effect.

By placing the cavity 22 and noisemaker 26 in the front part of the sole, the child will experience the least interference with or impediment to normal walking.

Figure 3:
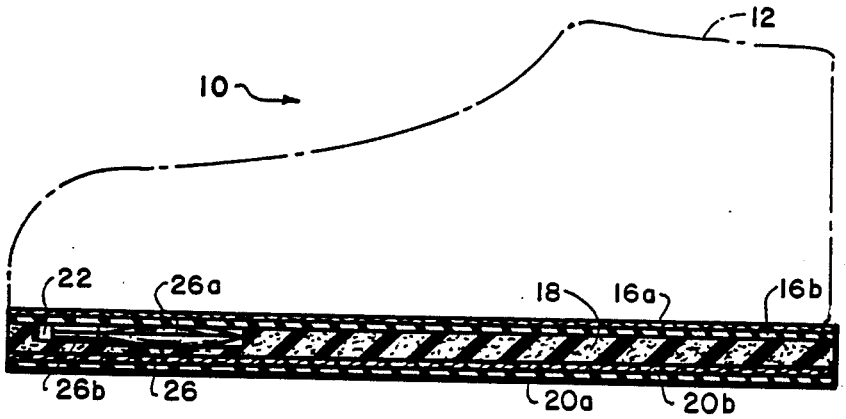
FIG. 3 is an enlarged side elevational view of the sole as shown in FIGS. 1 and 2, shown in cross-section to illustrate the details of construction of the different layers and the arrangement of the sound making device in relation to those layers.

The specific composition or makeup of the layers 16, 18 and 20 and the manner in which they are joined or connected to each other are not critical for purposes of the present invention. However, in the presently preferred embodiment, the upper layer 16 is advantageously formed of a fabric layer 16*a* attached to a thin layer of foam material 16*b* (FIG. 3). The middle or intermediate layer 18 is the thickest layer, in order to accommodate the noisemaker 26, while the lower layer 20 is formed of a lower vinyl layer 20*a* attached to a thin layer of foam material 20*b*. All of the layers, as shown in FIG. 3 are connected or joined to each other, once the noisemaker 26 has been placed within the cavity 22 to form the composite sole 14. As above suggested any conventional or appropriate connecting or joining means can be used including, but not limited to, thermal and adhesive bonding, or sewing. One or more of these techniques can be used to connect different layers in the same garment.

The invention and its intended advantages will be understood from the foregoing description, and it will become apparent that various changes may be made in the form, construction and arrangement of the parts of the invention without departing from the spirit and the scope thereof or sacrificing its material advantages. The arrangement hereinbefore described is merely by way of example, and the object of the present invention can be achieved even when such changes are made. For example, instead of a noisemaker in the form of a squeaker 26 or any other noisemaker or sound producing device may be used.

What is claimed is:

1. An item of children's clothing apparel including a foot portion adapted to receive the foot of a child, said foot portion including an upper and a sole which defines a toe portion formed of a resilient material, said toe portion having an enclosed cavity; and noisemaker means within said cavity for generating a predetermined noise when pressure is thereto when the child involuntarily applies pressure to said toe portion during walking to thereby depress said toe portion and compress said cavity and said noisemaker means to generate the desired noise effect.

2. An item as defined in claim 1, wherein the item of clothing apparel is a child's sleeping garment having a legged pants portion.

3. An item as defined in claim 1, wherein the item of clothing apparel comprises a children's pair of slippers.

4. An item as defined in claim 1, wherein said sole comprises a plurality of adjacent layers and said cavity is formed in an intermediate layers.

5. An item as defined in claim 4, wherein said intermediate layer is formed of a foam material.

6. An item as defined in claim 4, wherein the layers are provided, an upper layer above said intermediate layer and a lower layer below said intermediate layer.

7. An item as defined in claim 6, wherein said upper layer is formed of fabric.

8. An item as defined in claim 6, wherein said upper layer is formed of plastic.

9. An item as defined in claim 6, wherein said lower layer is formed of plastic.

10. An item as defined in claim 6, wherein said lower layer is formed of vinyl.

11. An item as defined in claim 6, wherein said lower layer is formed of fabric.

12. An item as defined in claim 6, wherein said upper layer is formed of a fabric layer attached to a layer of foam material.

13. An item as defined in claim 12, wherein said fabric layer is sewn to said layer of foam material.

14. An item as defined in claim 12, wherein said fabric layer is bonded to said layer of foam material.

15. An item as defined in claim 6, wherein said lower layer is formed of a plastic layer attached to a layer of foam material.

16. An item as defined in claim 15, wherein said plastic layer is sewn to said layer of foam material.

17. An item as defined in claim 15, wherein said plastic layer is bonded to said layer of foam material.

18. An item as defined in claim 1, wherein said noisemaker means comprises a squeaking device.

* * * * *